United States Patent [19]

Zellner

[11] Patent Number: 4,996,729

[45] Date of Patent: Mar. 5, 1991

[54] ADAPTABLE BATHING ASSISTANCE

[76] Inventor: John R. Zellner, 1610 King Ave., Kings Mills, Ohio 45034

[21] Appl. No.: 473,172

[22] Filed: Jan. 31, 1990

[51] Int. Cl.[5] ..... A47K 3/022

[52] U.S. Cl. ..... 4/539; 4/540; 4/547; 4/575; 4/578

[58] Field of Search ..... 4/539, 540, 547, 554, 4/555, 560, 571, 573, 574, 575, 578, 579, 589; 248/139, 141, 202.1, 268; 211/105.1, 123; 182/93, 151; D23/275, 281, 283, 304, 305

[56] References Cited

U.S. PATENT DOCUMENTS

| | | | |
|---|---|---|---|
| 1,094,644 | 4/1914 | Dullnig | 248/141 |
| 2,112,662 | 3/1938 | Bentz | 4/579 |
| 2,128,424 | 8/1938 | Marshall | D23/281 X |
| 2,364,860 | 12/1944 | Lloyd | 211/123 |
| 2,813,276 | 11/1957 | Lanza | 4/579 |
| 3,621,494 | 11/1971 | Bucher | 4/539 |
| 4,034,424 | 7/1977 | Budlong | 4/540 |
| 4,099,273 | 7/1978 | Colby | 4/540 |
| 4,197,838 | 4/1980 | Shill | 4/579 X |
| 4,583,251 | 4/1986 | Fürst et al. | 4/555 |
| 4,592,099 | 6/1986 | Zellner | 4/540 |

FOREIGN PATENT DOCUMENTS

| | | | |
|---|---|---|---|
| 2634103 | 2/1978 | Fed. Rep. of Germany | 248/268 |
| 165134 | 6/1921 | United Kingdom | 4/554 |
| 275913 | 8/1927 | United Kingdom | 4/554 |
| 1334514 | 10/1973 | United Kingdom | 4/574 |

*Primary Examiner*—Henry J. Recla
*Assistant Examiner*—Robert M. Fetsuga

[57] ABSTRACT

A bathing device including tub surround panels useful with a conventional bath tub or with a tub configured to the special needs of the disabled. The panels have unobtrusively reinforced side panels recessed to accept a full length chair height reclining shower seat and a tilting bath tube to contain the bathing water for use when these bathing aids are necessary or desirable. When they are no longer needed, the seat and tube are easily removed and the surround panels are restored to their original appearance.

9 Claims, 3 Drawing Sheets

ADAPTABLE BATHING ASSISTANCE

FIELD OF THE INVENTION

This invention relates to the field of bathtubs, especially bath tubs which are adaptable to the changing demands of those who have decreasing abilities to care for themselves.

BACKGROUND OF THE INVENTION

Innumerable studies and publications report "The Graying of America", i.e., the percentage of the population which is "aged" or "chronologically gifted" is constantly increasing. What is certain about this phenomenon, but much less frequently mentioned, is the declining capacity of the aged to care for themselves. It has been concluded, sadly, that when such necessary activities as food preparation, hygenic functions, grooming, and the like, consume the entire day, the quality of life is zero. In other words, there no longer is time for elective and pleasurable pursuits.

The logical solution to the reduction of abilities through ageing is the application of resources, human and mechanical, to ease the performance of these tasks by bringing the aid to the person and by bringing the person to the aid.

Although ageing persons generally realize that disabilities of one sort or another have made life more arduous, nearly all desire to remain among famililar and friendly surroundings and companions. For the large number who resist relocation, help is sought in the form of mechanical devices. But what is highly important in the minds of the ageing is that any mechanical help must not appear to be too different from their usual environment. Especially, it must not be suggestive of a hospital or nursing home. The strong tendency is to avoid as long as possible anything that labels them as "frail" or "old" or "infirm".

Bath tubs and wall enclosures already known are shown in U.S. Pat. Nos. 3,588,925 and 4,080,710. The invention of U.S. Pat. No. 4,592,099 provides ample assistance to many disabled, but some find little immediate need for all the benefits that this bathing system makes available, recognizing, of course, that it will be desirable in the future.

BRIEF SUMMARY OF THE INVENTION

The instant invention resides in tub surround panels useful with a conventional bath tub or with a tub configured to the special needs of the disabled. Unobtrusively reinforced side panels are recessed to accept a full length chair height reclining shower seat and a tilting bath tube to contain the bathing water for use when these bathing aids are necessary or desireable. When they are no longer needed, the seat and tube are easily removed and the side panels and back wall are restored to their original appearance. The invention will be more fully understood from the following drawings and description.

THE DRAWINGS

DETAILED DESCRIPTION

Figure 1:
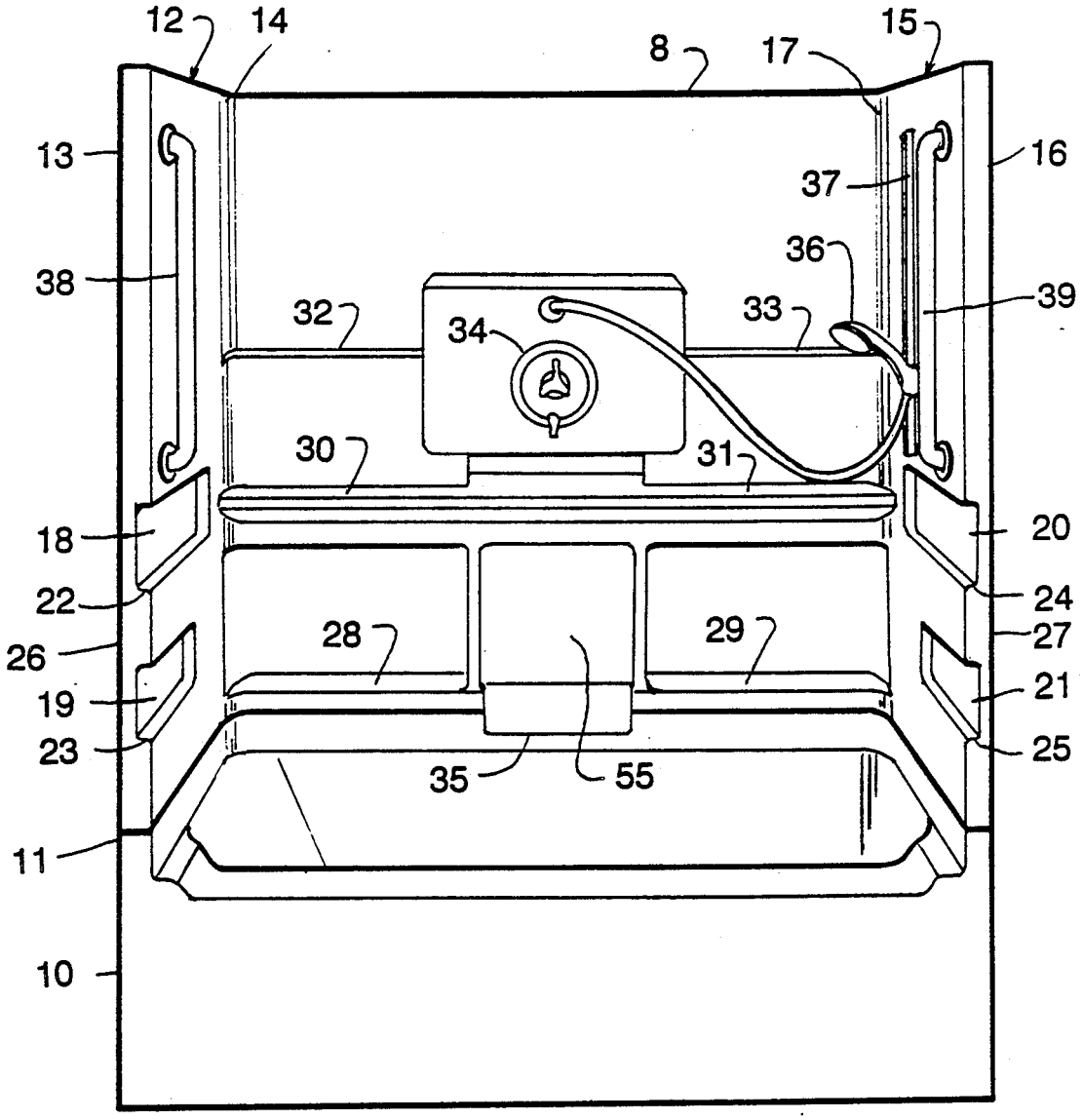
FIG. 1 is a view of a tub surround including the recessed side panels atop a conventional style bath tub.

Referring to FIG. 1, there is shown a bath tub 10 having a rim 11. The tub may or may not have been modified in detail to accomodate the special needs of the mobility impaired. A surround to protect the bathing enclosure from splashed water includes an upstanding first side panel 12 having a front edge 13 and a rear margin 14. An opposed upstanding second side panel 15 has a front edge 16 and a rear margin 17. A back wall 8 connects the side panels at their rear margins. The panels 12 and 15 and the back 8 surmount the tub and are joined to the rim 11 with a water tight seal. Constructing the surround and tub as separate elements overcomes the bulkiness of a one piece unit which may be difficult or impossible to transport through narrow passages to the bathroom location. This is especially true in remodeling work.

The side panels have opposed matching recesses which open to the respective front edges of said side panels. In a preferred embodiment, side wall 12 has an upper recess 18 and a lower recess 19; side wall 15 has an upper recess 20 and a lower recess 21. The recesses have lower surfaces 22, 23, 24, and 25 respectively which open to the front edges of the walls. In a preferred embodiment the surfaces 22, 23, 24 and 25 are substantially horizontal. The upper surface of each recess diverges slightly from the lower surface so that the vertical dimension of each recess is greatest where it meets the edge of the side wall.

The surround, bath and shower seat and tiltable tube are constructed of fiberglass reinforced polyester laminate with a sanitary gel coat but other suitable materials may be used. The areas 26 and 27 behind the recesses are reinforced during manufacture by molding in a strengthening material of suitable characteristics and dimensions. Marine plywood is one such material.

Also shown in FIG. 1. are molded-in hselves 28, 29, 30, 31, 32 and 33 which are of sufficient strength and of appropriate configuration to serve as supplemental body support surfaces to conveniently aid the bather when entering or leaving the tub or also to hold bath materials such as soap, shampoo and the like. The water control 34 is located above a cascade water discharge 35 and also controls the shower spray head 36 which rides on a positioning bar 37. Grab bars 38 and 39 are provided for additional support to a bather.

Figure 2:
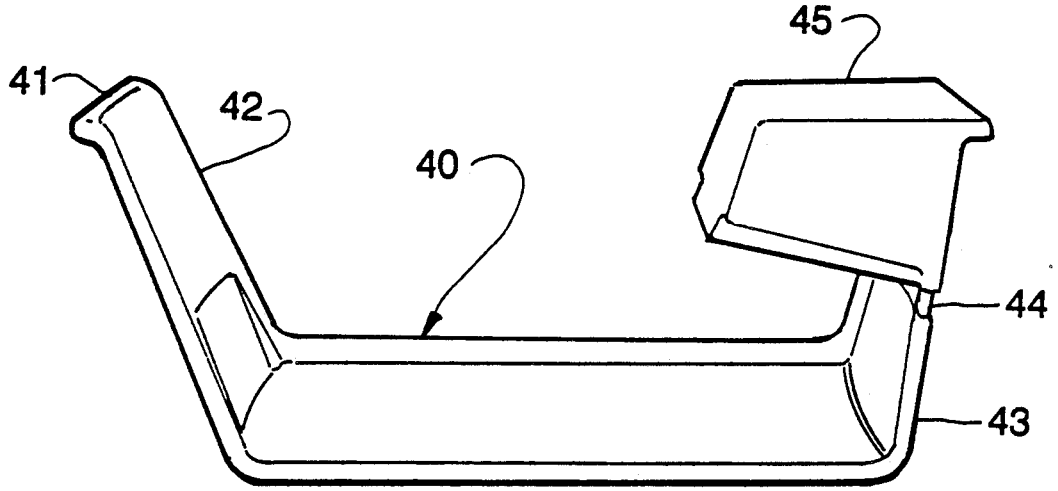
FIG. 2 is a view of reclining bath and shower seat and its supporting accessory.

Referring to FIG. 2 there is shown a reclining bathing and shower seat 40 having a rest 41 at the top of the back 42. The foot end 43 is secured with a hinge 44 or other suitable movable mount. A counter balancing apparatus (not shown) is located within console 45. Optional water controls may also be mounted on the console.

Figure 3:
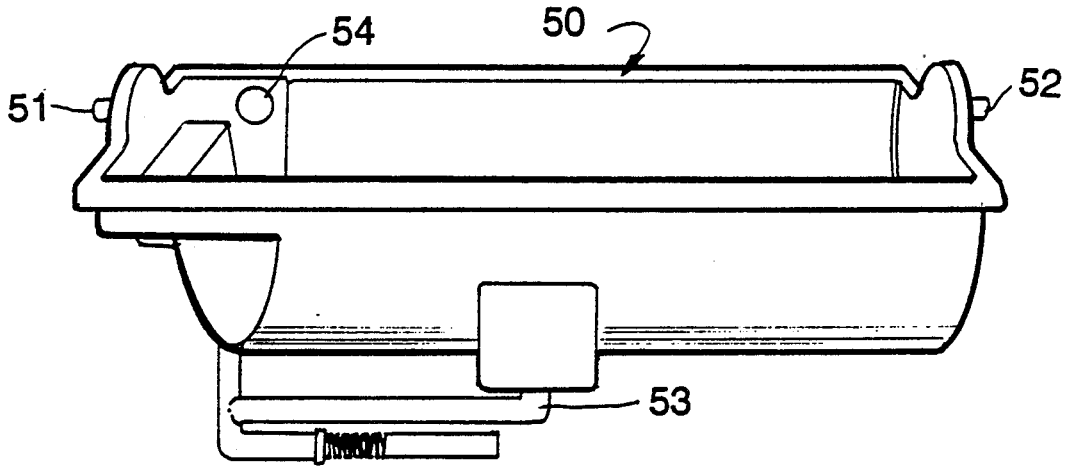
FIG. 3 is a view of a tiltable bath tube.

Referring to FIG. 3, there is shown a bath tube 50 which is tiltable about pivots 51 and 52. Drain apparatus 53 is operated remotely by knob 54.

Figure 4:
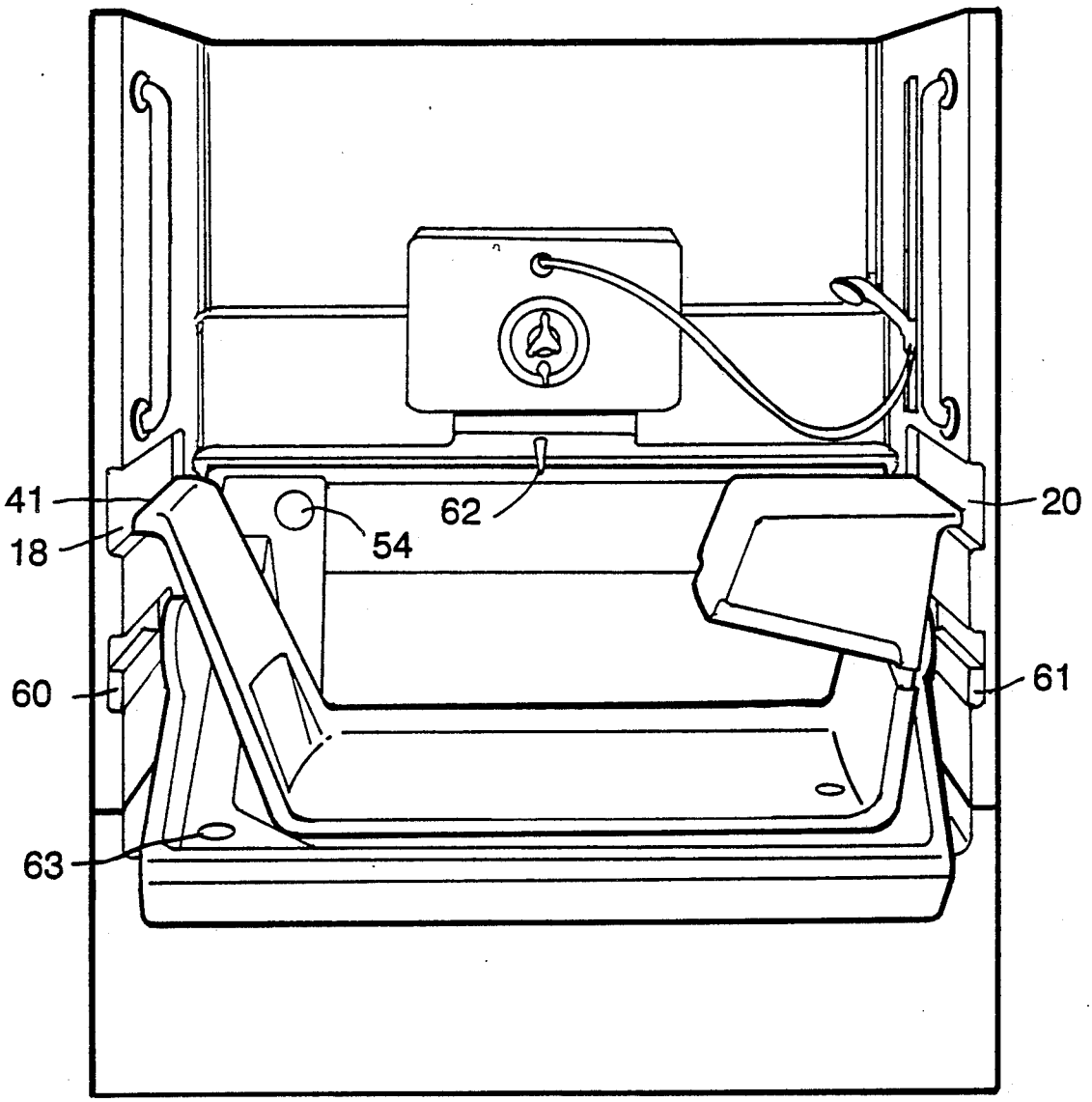
FIG. 4 is a view showing an assembly of the parts of FIGS. 1, 2 and 3.

When a bather or the bather's caregiver elects to transform the bath apparatus of FIG. 1 to that of FIG. 4, plate 55 is removed to expose a latch on the back wall 8. The pivots 51 and 52 on tube 50 are placed on surfaces 23 and 25 of the lower recesses 19 and 21 and moved toward the back wall 8 until they reach the limit of the recess. The pivots are secured in this location with blocks 60 and 61 which are attached with bolts inserted in predrilled holes. When not needed the holes are concealed with removable caps. Handle 62 is inserted to operate the latch which engages a detent on the tube to maintain it in either an open inclined position shown in FIG. 4 or horizontal closed position. The counterbalance mechanism inside the console 45 is located on the surface 24 in the recess 20 and fastened to the wall at that location with bolts inserted in predrilled holes. The top 41 of the seat 40 then engages and rests on the surface 22 of the matching opposed recess 18.

To take a bath, a bather sits on the seat as one might sit on the edge of a bed, and once seated, swings the feet onto the foot 43 of the seat 40. Water spray may be started over the bather at this time, or the tube 50 may be first tilted to the horizontal position by releasing the latch with handle 62 and moving the tube to the horizontal or soaking position. In this position, overflow 63 directs any excess water to the drain. While there is water in the tube, a float interlock prevents accidental tilting from the horizontal. Upon completion of the bath, the water is released by rotation of knob 54 and when the water level is low enough to release the interlock, the handle 62 is moved to release the latch and permit returning the tube to its original inclined position so the bather may exit. It is a considerable advantage that while entering or leaving the tube the bather need never support his weight on his feet while they are on a wet and/or slippery surface.

To wipe the interior of the tube, the reclining seat 40 is lifted to provide improved access, an operation which is greatly aided by the counterbalance concealed in the console 45.

Should a bather recover from an infirmity and desire to return to use of the apparatus of FIG. 1, the seat 40 and tube 50 are readily removed by reversing the installation steps described above and replacing the concealing caps in the now empty bolt holes.

The embodiments described above and illustrated in the drawings are, of course, to be regarded as non-limiting examples and as to their details may be modified in several ways within the scope of the following claims.

What is claimed is:

1. A bath tub bathing device comprising a tub surround surmounting the tub, said surround comprising two opposed upstanding panels, two opposed matching recesses, one in each panel, each recess opening to the edge of its respective panel, each recess having a lower surface adapted to support a pivot of a tiltable bath tube insert.

2. The bathing device of claim 1 wherein each panel has a pair of opposed matching recesses, one above the other, each recess having a substantially horizontal lower surface opening to the front edge of the panel.

3. The bathing device of claim 2 wherein the lower recess on each panel is adapted to receive and support a pivot of a tiltable tube and a block to secure said pivot in said recess.

4. The bathing device of claim 2 wherein each of the upper recesses is adapted to receive and support a bathing seat between them.

5. The bathing device of claim 4 wherein the bathing seat is hinged at one end.

6. The bathing device of claim 2 wherein the lower recess on each panel had received and supports a pivot of the tiltable bath tube, and a block located on the lower surface of the recess, said block securing the pivot.

7. The bathing device of claim 6 including a bath seat, wherein the upper recess in each panel has received an end of the bath seat to support the seat between the panels.

8. The bathing device of claim 2 including a bath seat, wherein the upper recess in each panel has received an end of the bath seat to support the seat between the panels.

9. The bathing device of claim 1 including a tiltable bath tube having a pivot on each end, wherein the recess on each panel has received and supports a pivot of the tiltable bath tube.

* * * * *